US011375834B2

(12) United States Patent
Barrett

(10) Patent No.: US 11,375,834 B2
(45) Date of Patent: Jul. 5, 2022

(54) COUPLING FOR A DRINKING STRAW

(71) Applicant: Ryan Barrett, Merritt Island, FL (US)

(72) Inventor: Ryan Barrett, Merritt Island, FL (US)

( * ) Notice: Subject to any disclaimer, the term of this patent is extended or adjusted under 35 U.S.C. 154(b) by 0 days.

(21) Appl. No.: 16/594,420

(22) Filed: Oct. 7, 2019

(65) Prior Publication Data

US 2021/0219760 A1 Jul. 22, 2021

(51) Int. Cl.
*A47G 21/18* (2006.01)

(52) U.S. Cl.
CPC ..... *A47G 21/189* (2013.01); *A47G 21/18* (2013.01)

(58) Field of Classification Search
CPC ..... A47G 21/18–189; A61J 7/0038; A61J 15/0011; E03C 1/0404; E03C 2001/0414; E03C 1/025; E03C 1/0412; E03C 1/057; E03C 2001/0415; F16L 37/004; F16L 27/0849; F16L 9/22; F16L 11/18; F16L 27/087; F16L 55/07; F16L 33/30; F16L 27/12; F16L 27/127; F16L 27/1273; F16L 27/1274; F16L 27/1275; F16L 27/12751; Y10T 292/11; Y10T 29/49361; Y10T 403/7016; Y10T 403/7069; F16B 2001/0035
USPC ..... 239/33, 330; 403/361; 285/9.1, 298, 285/302, 303
See application file for complete search history.

(56) References Cited

U.S. PATENT DOCUMENTS

| | | | | |
|---|---|---|---|---|
| 1,001,218 | A | 8/1911 | Parenteau | |
| 2,269,593 | A | 1/1942 | Maltby et al. | |
| 4,049,295 | A * | 9/1977 | Piers | F16L 37/004 285/9.1 |
| 4,657,182 | A | 4/1987 | Hoshi | |
| 4,850,533 | A | 7/1989 | Hoshi et al. | |
| 5,820,023 | A | 10/1998 | Kristensson | |
| D449,092 | S | 10/2001 | Brog et al. | |
| D603,206 | S | 11/2009 | Wallace | |
| 8,540,926 | B2 | 9/2013 | Crawley | |
| 8,579,148 | B2 | 11/2013 | Slansky | |
| 8,608,016 | B2 | 12/2013 | Chiu et al. | |
| D762,408 | S | 8/2016 | Palazzi | |
| D798,095 | S | 9/2017 | Palazzi | |

(Continued)

FOREIGN PATENT DOCUMENTS

| | | | |
|---|---|---|---|
| CN | 209391621 | U | 9/2019 |
| FR | 622685 | A | 6/1927 |
| KR | 20190069005 | A | 6/2019 |

OTHER PUBLICATIONS

International Search Report and Written Opinion in related application PCT/US2020/070617 dated Mar. 5, 2021; 9 pages.

*Primary Examiner* — Qingzhang Zhou
*Assistant Examiner* — Juan C Barrera
(74) *Attorney, Agent, or Firm* — Kelly G Swartz; Widerman Malek, PL

(57) ABSTRACT

A coupling including a first elongate member and a second elongate member. The first elongate member includes a first tube and a first magnet. The first tube has a first end and a second end. The first magnet secures to the first end of the first tube. The second elongate member includes a second tube and a second magnet. The second tube has a first end and a second end. The second magnet secures to the first end of the second tube. The first and second magnets are cooperatively configured to attract one another and secure the first end of the first tube to the first end of the second tube.

13 Claims, 7 Drawing Sheets

(56) References Cited

U.S. PATENT DOCUMENTS

| | | | | |
|---|---|---|---|---|
| 9,820,597 | B1 | 11/2017 | Chang et al. | |
| 9,974,403 | B1 | 5/2018 | O'Neill | |
| 10,123,641 | B1 * | 11/2018 | Pepper | A47L 17/00 |
| D847,568 | S | 5/2019 | Hartnett | |
| D853,164 | S | 7/2019 | Pepper | |
| D853,193 | S | 7/2019 | Hartnett | |
| 2009/0256000 | A1 | 10/2009 | Wallace | |
| 2015/0014431 | A1 | 1/2015 | Whittaker et al. | |
| 2015/0196150 | A1 | 7/2015 | Chang et al. | |
| 2017/0241850 | A1 | 9/2017 | Coon et al. | |
| 2018/0160831 | A1 | 6/2018 | Yoo | |
| 2018/0352983 | A1 | 12/2018 | Allen | |
| 2019/0038058 | A1 | 2/2019 | Abbott-Glazier | |
| 2019/0257453 | A1 * | 8/2019 | Leidefeldt | B62D 33/067 |

* cited by examiner

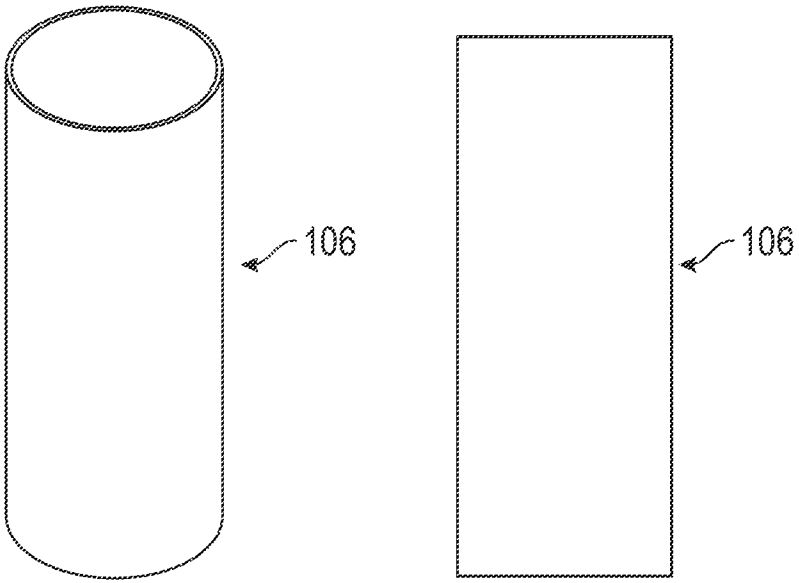
FIG. 18
FIG. 19
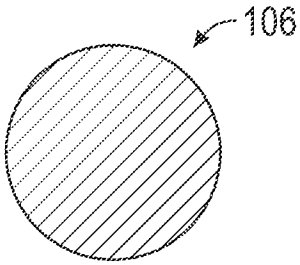
FIG. 20
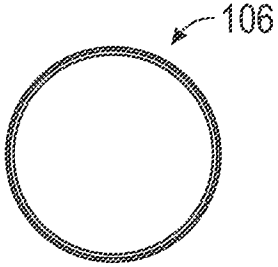
FIG. 21

COUPLING FOR A DRINKING STRAW

FIELD OF THE INVENTION

The present invention relates to systems and methods for coupling two hollow structures. Specifically, the present invention relates to coupling and storing two halves of a drinking straw system.

BACKGROUND OF THE INVENTION

Over 500,000,000 plastic straws are used each day in the United States and are then disposed of after a single use. In only the past twenty years, people have come to expect plastic straws in every drink, in an example of extreme waste being generated for convenience. These short-lived tools are usually dropped into a garbage can with no further thought, instantly becoming a source of plastic pollution (http://www.plasticpollutioncoalition.org/no-straw-please/).

The consumption of 500 million single-use plastic straws a day is enough straws to wrap around the circumference of the earth 2.5 times per day. Currently, it is nearly impossible to recycle plastic straws, which often end up in a dump. Plastic straws are also swept away by winds and end up in waterways, and eventually move into the oceans. Plastic straws are confused as food by fish and seabirds. In a recent study, it was estimated that approximately 60% of seabirds currently have plastic in their stomachs, and by 2050, 99% percent of seabirds will have plastic in their stomachs.

In an effort to combat this massive environmental problem, single-use plastic straws are being banned in restaurants, cafes, and bars all around the world. For example, the city of Seattle, Wash. banned all plastic straws as of Jan. 1, 2018. Other countries, states, and cities are in the process of implementing similar bans of single-use plastic straws. Despite governmental efforts and increased public awareness of the environmental problems caused by single-use plastic straws, plastic straws are still being served in many places.

One solution to not using plastic straws is for people to carry their own reusable straws. However, reusable straws are often made out of glass or metal and, by nature, are long and inconvenient to carry around. Glass straws break easily and require a bulky case to keep them from shattering. If people are to bring reusable straws everywhere, they will need somewhere dean to store the reusable straw. That means keeping the reusable straw in a case that is even bigger and bulkier than the glass and metal straws in their current form. Therefore, there exists a need for a convenient reusable drinking straw that is easy to carry, store, and clean.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a coupling including a first elongate member and a second elongate member. The first elongate member includes a first tube and a first magnet. The first tube has a first end and a second end. The first magnet is secured to the first end of the first tube. The second elongate member includes a second tube and a second magnet. The second tube has a first end and a second end. The second magnet is secured to the first end of the second tube. The first and second magnets are cooperatively configured to attract one another and secure the first end of the first tube to the first end of the second tube.

The first end of the second tube is configured to receive and carry the first end of the first tube.

The first magnet is positioned on an exterior surface of the first end of the first tube and the second magnet is positioned on an interior surface of the first end of the second tube.

The first end of the second elongate member has an interior diameter greater than an exterior diameter of the first end of the first elongate member.

The first end of the first tube has a recess defined by an area of the first end having an exterior circumference smaller than an exterior circumference of a remainder of the first tube.

The first magnet s secured to the recess.

The first magnet covers an entirety of the recess.

The second tube has a first portion having a first interior diameter and a second portion having a second interior diameter less than the first interior diameter.

The second tube has a transition portion located between the first portion and the second portion and the transition portion has a tapered interior diameter.

The tapered interior diameter of the transition portion forms a 135-degree angle with respect to an interior surface of the second portion.

The second tube has a third portion having a third interior diameter greater than the first interior diameter.

The second magnet is secured to an interior surface of the third portion.

The second magnet covers an entirety of the interior surface of the first portion.

The second end of the second elongate member is configured to receive the second end of the first elongate member in a nested configuration.

In one embodiment, the coupling may be part of a straw system, which includes a receiving component and a lid component.

The receiving component carries the first elongate member and second elongate member in the nested configuration.

The lid component is configured to secure to an open end of the receiving component to store the first and second elongate members within a cavity defined by an interior surface of the receiving component and lid component in a coupled configuration.

The receiving component further includes a post secured to an interior side of a closed end of the receiving component. The post is configured to engage the first end of the first elongate member.

The receiving component further comprises a third magnet secured to the post and configured to attract the first magnet of the first elongate member.

The third magnet surrounds an entirety of a circumference of the post.

BRIEF DESCRIPTION OF THE DRAWINGS

Some embodiments of the present invention are illustrated as an example and are not limited by the figures of the accompanying drawings, in which like references may indicate similar elements.

FIG. 18 is a perspective view of the lid component of the container component of FIG. 3, FIG. 19 is a side elevation view of the lid component of FIG. 18.

FIG. 20 is a top plan view of the lid component of FIG. 18.

FIG. 21 is a bottom plan view of the lid component of FIG. 18.

DETAILED DESCRIPTION OF THE INVENTION

Figure 1:
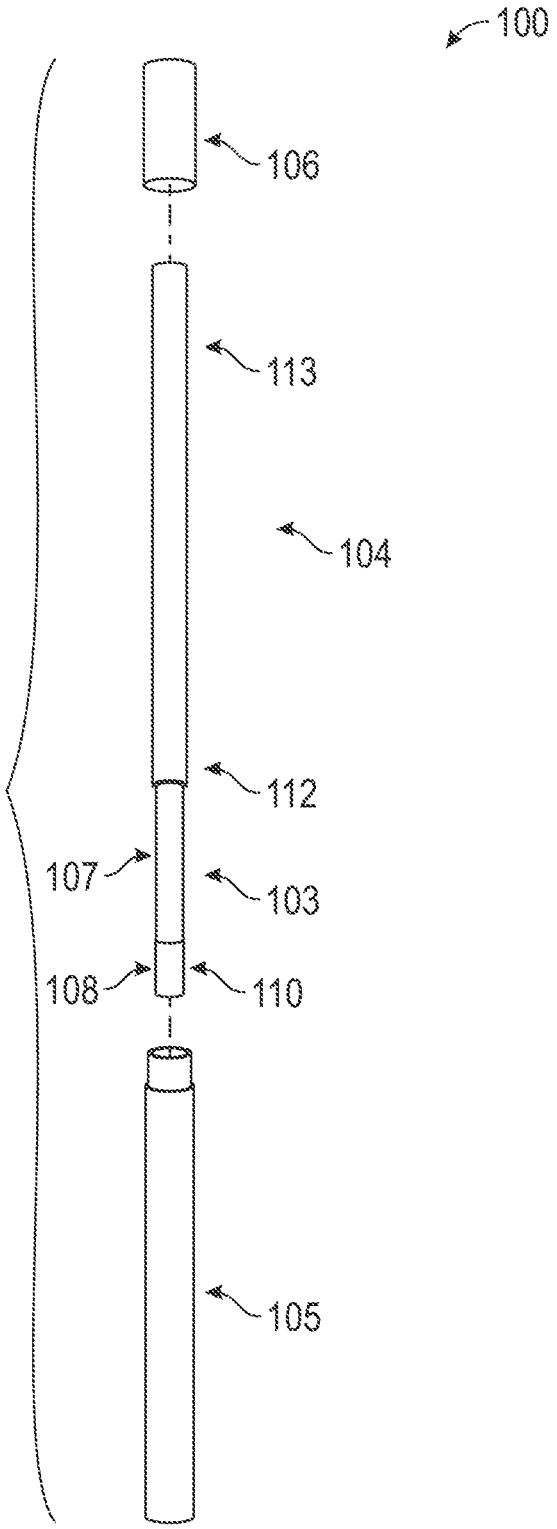
FIG. 1 is an exploded view of the straw system according to an embodiment of the present invention.
Figure 2:
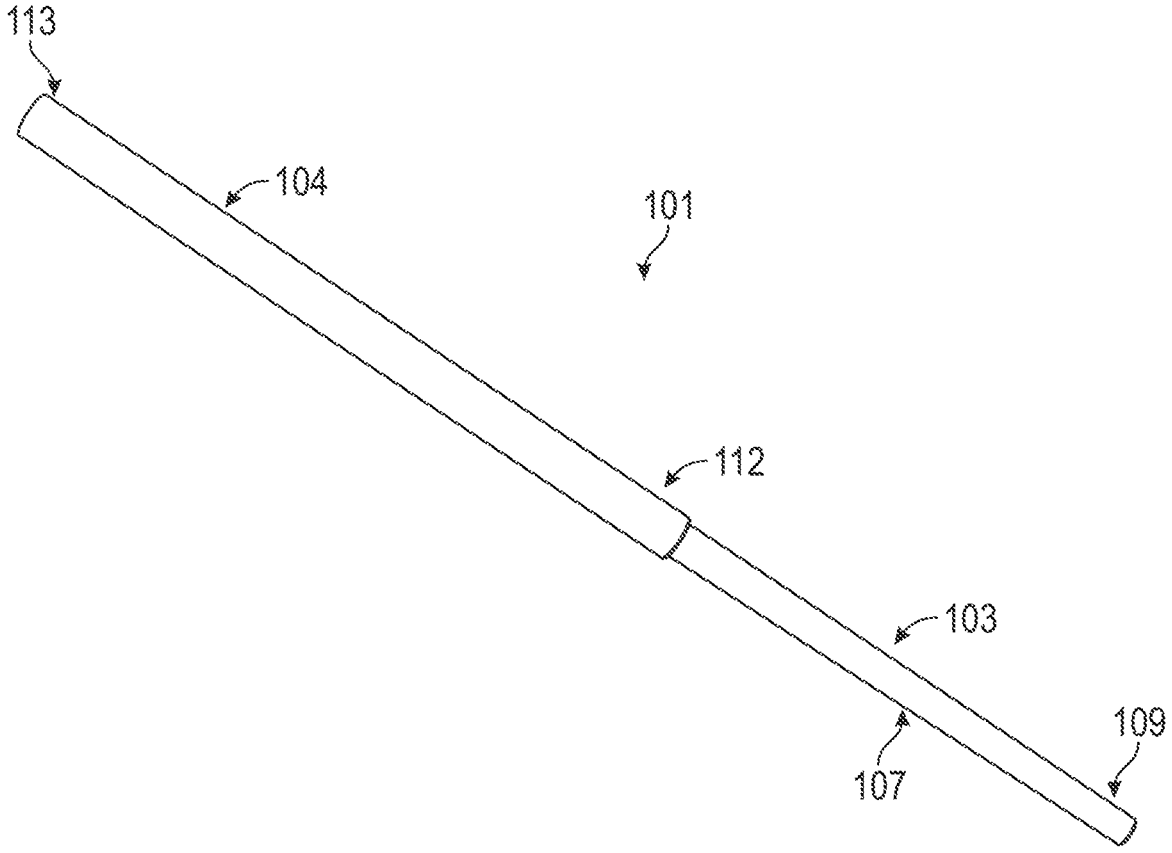
FIG. 2 is a perspective view of the straw component of the straw system of FIG. 1.
Figure 3:
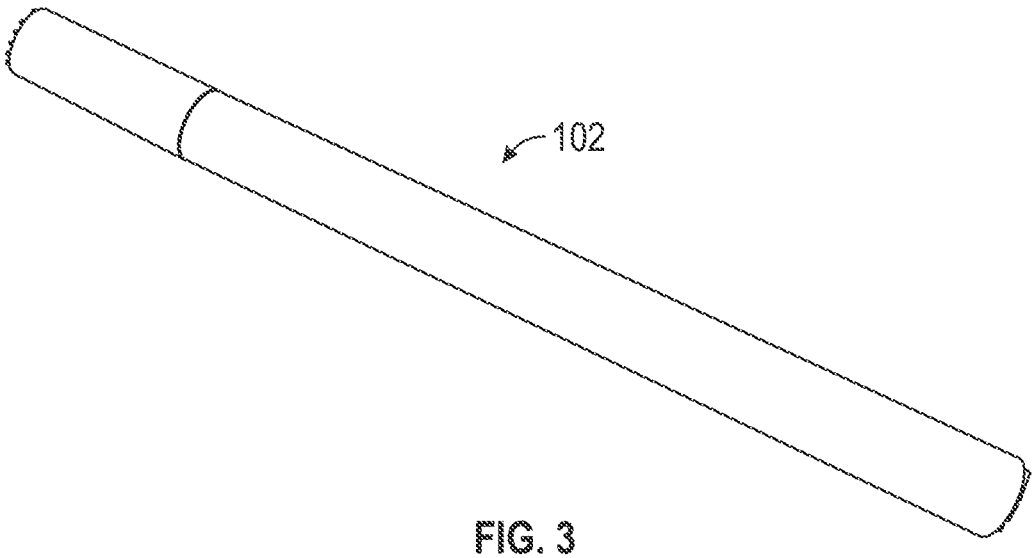
FIG. 3 is a perspective view of the container component of the straw system of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a coupling, which may be used to join two hollow structures. In one embodiment, the coupling may join two halves of a straw system 100. The straw system 100 may include a straw component 101 and a container component 102. The coupling may be present on the straw component 101 and be utilized to join a first elongate member 103 of the straw component 101 to a second elongate member 104 of the straw component 101.

The first elongate member 103 may include a first tube 107 having a first end 108 and a second end 109, a first magnet 110, and a recess 115.

The second elongate member 104 may include a second tube 111, having a first end 112 and a second end 113, a second magnet 114, a first portion 116, a second portion 117, a third portion 118, and a transition portion 119.

Figure 4:
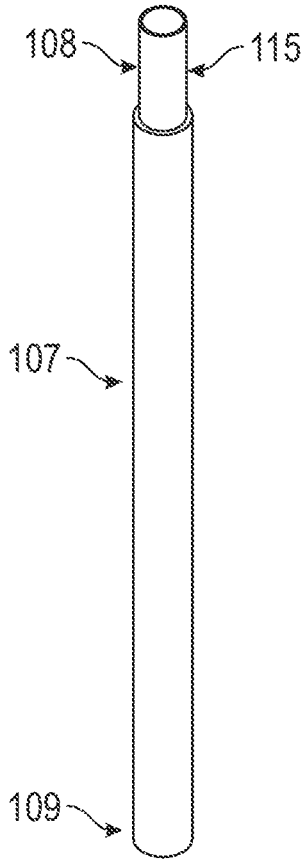
FIG. 4 is perspective view of the first tube of the first elongate member of FIG. 22.
Figure 5:
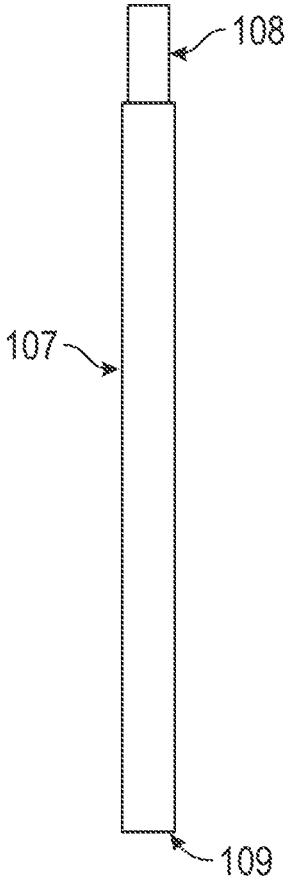
FIG. 5 is a side elevation view of the first tube of FIG. 4.
Figure 6:
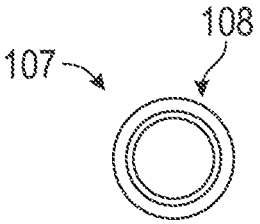
FIG. 6 is a top plan view of the first tube of FIG. 4.
Figure 7:
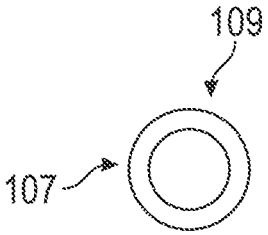
FIG. 7 is a bottom plan view of the first tube of FIG. 4.
Figure 12:
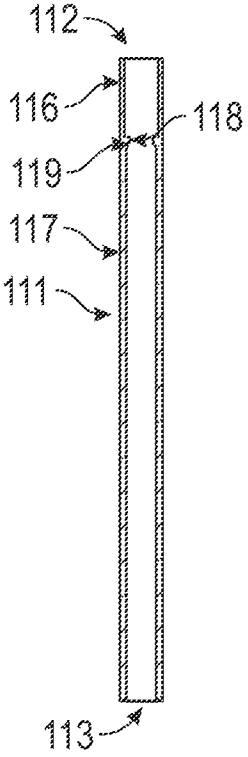
FIG. 12 is a cross-section view of the second tube taken through line 12-12 of FIG. 9.
Figure 10:
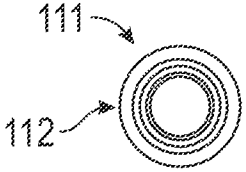
FIG. 10 is a top plan view of the second tube of FIG. 8.
Figure 11:
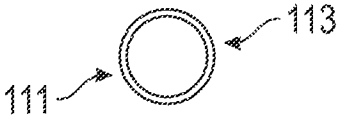
FIG. 11 is a bottom plan view of the second tube of FIG. 8.
Figure 9:
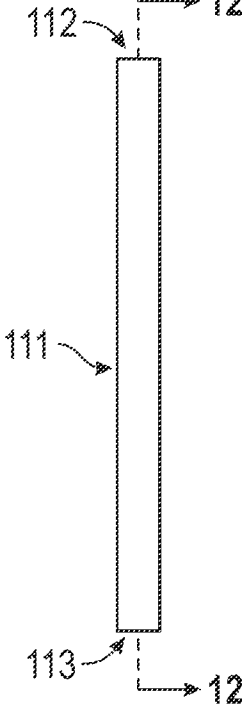
FIG. 9 is a side elevation view of the second tube of FIG. 8.
Figure 8:
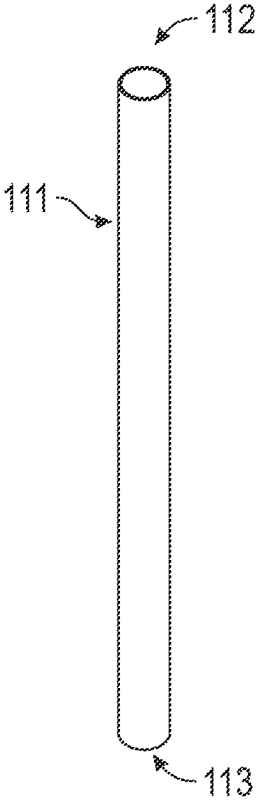
FIG. 8 is a perspective view of the second tube of the second elongate member of FIG. 24.
Figure 17:
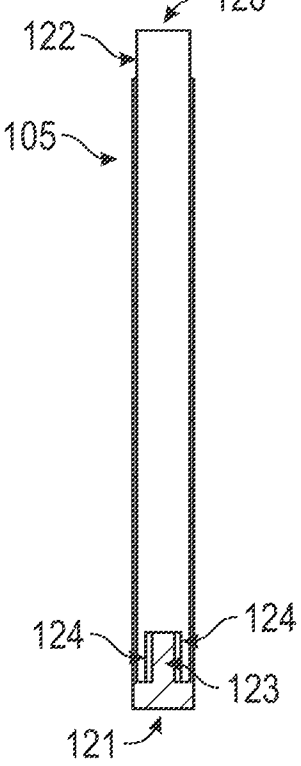
FIG. 17 is a cross-section view of the receiving component taken through line 17-17 of FIG. 14.
Figure 15:
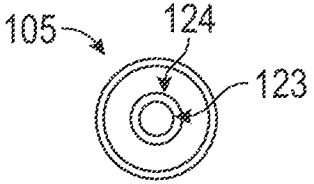
FIG. 15 is a top plan view of the receiving component of FIG. 13.
Figure 16:
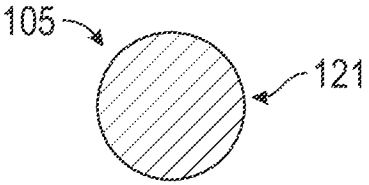
FIG. 16 is a bottom plan view of the receiving component of FIG. 33.
Figure 14:
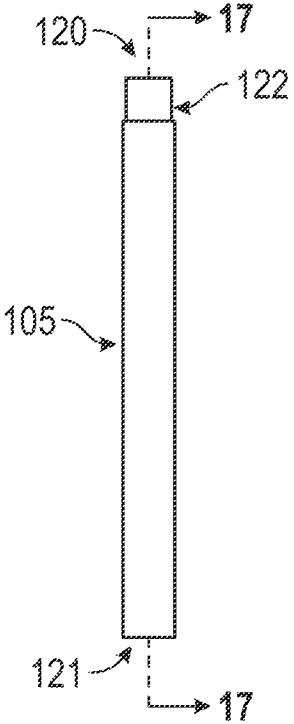
FIG. 14 is a side elevation view of the receiving component of FIG. 13.
Figure 13:
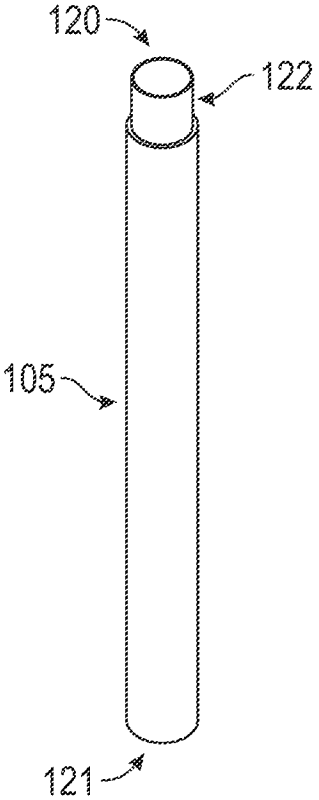
FIG. 13 is a perspective view of the receiving component of the container component of FIG. 3.
Figure 22:
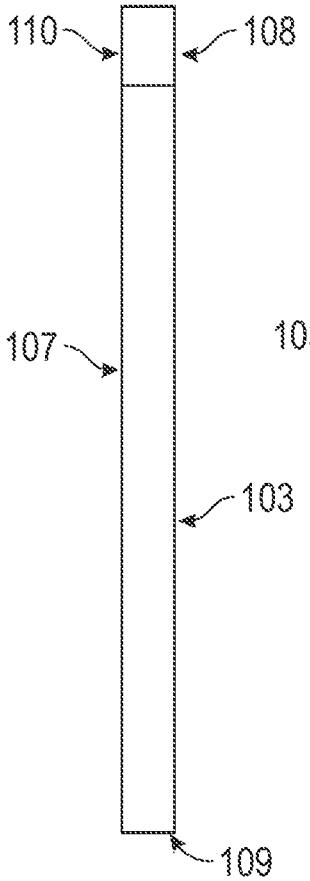
FIG. 22 is a side elevation view of the first elongate member of the straw component of FIG. 2.
Figure 23:
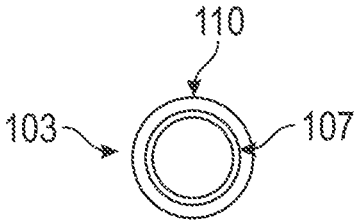
FIG. 23 is a top plan view of the first elongate member of the straw component of FIG. 2.
Figure 24:
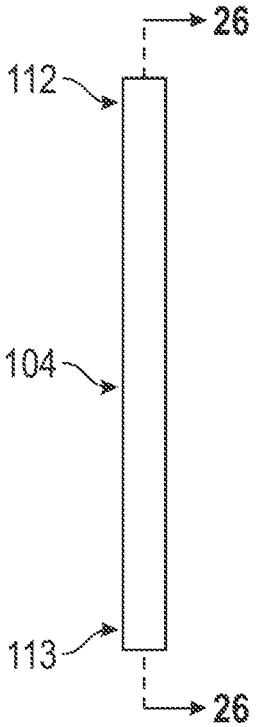
FIG. 24 is a side elevation view of the second elongate member of the straw component of FIG. 2.
Figure 25:
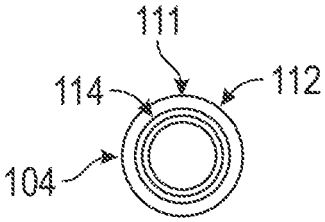
FIG. 25 is a top plan view of the second elongate member of FIG. 24.
Figure 26:
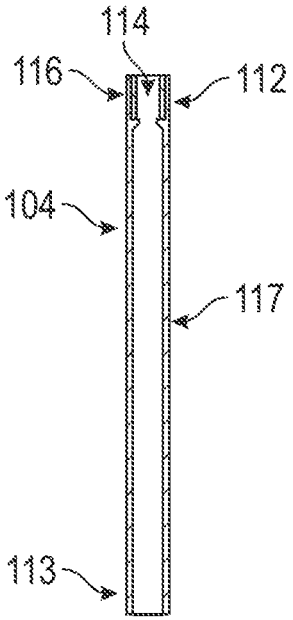
FIG. 26 is a cross-section view of the second elongate member taken through line 26-26 of FIG. 24.
Figure 27:
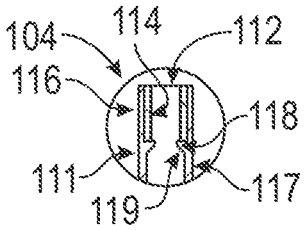
FIG. 27 is a detailed view of the area labeled A in FIG. 26.

The coupling between the first elongate member 103 and the second elongate member 104 may include a first magnet 110 secured to the first elongate member, as depicted in FIGS. 22 and 23, and a second magnet 114 secured to the second elongate member 104, as depicted in FIGS. 25 and 26. In such an embodiment, the first elongate member 103 may include a first tube 107, having a first end 108 and an opposing second end 109. The first tube 107 may be a hollow, cylindrical member with a uniform interior diameter extending the entirety of the length of the first tube 107 from the first end 108 to the second end 109. As shown in FIGS. 4 and 5, a recess 115 may be located on the first end 108 of the first elongate member 103. The recess 115 may be defined by an exterior surface of the first tube 107 having an exterior circumference smaller than the exterior circumference of the second end 109 of the first tube 107 and the portion of the first tube 107 between the bottom end of the recess 115 and the second end 109 of the first tube 107. The first magnet 110 may be secured to an exterior surface of the first tube 107. In embodiments having a recess 115, the first magnet 110 may be secured to the external surface of the recess 115. The first magnet 110 may be a flexible, elongate structure, including, but not limited to, magnetic tape having an adhesive surface located on a surface contacting the recess 115. The first magnet 110 may be secured to the first tube 107 around an entirety of an external surface the first end 108 of the first tube 107. The first magnet 110 may have an adhesive backing, which may be secured to the exterior surface of the first tube 107, more specifically, the first magnet 110 may be secured to the recess 115. The first magnet 110 may have a length equal to the exterior circumference of the recess 115 and a width equal to the height of the recess 115. The first magnet 110 may cover an entirety of the surface of the recess 115. The thickness of the first magnet 110 may be equal to the depth of the recess 115. In such an embodiment, the exterior circumference of the first elongate member 103 may be uniform along an entirety of the length of the first elongate member 103 from the first end 108 to the second end 109 when the first magnet 110 is secured to the first tube 107.

The second elongate member 104 may include a second tube 111 having a length extending from a first end 112 to a second end 113. A second magnet 114 may be secured to the first end 112 of the second tube 111. In one embodiment, the second magnet 114 may secure to an interior surface of the second tube 111.

The first elongate member 103 and the second elongate member 104 may be cooperatively configured to allow the first end 112 of the second tube 111 to carry the first end 108 of the first tube 107, In such a coupled configuration, the first magnet 110 and the second magnet 114 may attract one another to maintain the mated position of the first elongate member 103 and the second elongate member 104. The first elongate member 103 and the second elongate member 104 may be decoupled by applying lateral pressure to one or both of the first elongate member 103 or second elongate member 104 to move the members 103, 104 away from one another. The amount of lateral pressure sufficient to decouple the members 103, 104 may be easily provided by a human of average strength.

The interior diameter of the first end 112 of the second elongate member 104 may be greater than the exterior diameter of the first end 108 of the first elongate member 103.

The second tube 111 of the second elongate member 104 may have first portion 116 having an interior diameter greater than an interior diameter of a second portion 117. The first portion 116 may be proximate the first end 112 of the second tube 111 and the second portion 117 may be proximate the second end 113 of the second tube. The interior diameter of the first portion 116 may be continuous along an entirety of the length of the first portion 116. The interior diameter of the second portion 117 may be continuous along an entirety of the length of the second portion 117.

A transition portion 119 may be located along the interior of the second tube 111 between the first portion 116 and the second portion 117. The interior diameter of the transition portion 119 may be equal to the interior diameter of the second portion 117 at the location where the second portion 117 and transition portion 119 are adjacent or connect to one another. The interior diameter of the transition portion 119 may taper to a smaller interior diameter in the direction opposing the second portion 117. The interior diameter of the transition portion 119 may taper at a constant slope. In embodiments in which the transition portion 119 is adjacent the first portion 116, the interior diameter of the transition portion 119 may equal the interior diameter of the first portion 116 at the location at which the transition portion 119 and first portion 116 are adjacent or connect to one another. In embodiments, in which the first portion 116 and the transition portion 119 are not adjacent, the interior diameter of the transition portion 119 may taper to an interior diameter smaller than the interior diameter of the first portion 116. The interior surface of the transition portion 119 may form a 135 degree angle with the interior surface of the second portion 117.

In one embodiment, a third portion 118 may be located between the first portion 116 and the second portion 117 and between the first portion 116 and the transition portion 119. The third portion 118 may be adjacent the first portion 116. The interior diameter of the third portion 118 may be less than the interior diameter of the second portion 117 and the first portion 116, The interior diameter of the third portion 118 may be uniform along an entirety of a length of the third portion. In embodiments without a transition portion 119, the third portion 118 may be adjacent the second portion 117. In embodiments having a transition portion 119, the third portion 118 may be located between the first portion 116 and the transition portion 119. In such an embodiment, the interior diameter of the third portion 118 may be equal to the interior diameter of the transition portion 119 at the location at which the third portion 118 and transition portion 119 are adjacent or secured to one another.

The second magnet 114 may be secured to the interior surface of the first portion 116. The second magnet 114 may be a flexible, elongate structure. The second magnet 114 may be secured to the second tube 111 around an entirety of an interior surface the first end 112 of the second tube 111. The second magnet 114 may have an adhesive backing, which may be secured to the interior surface of the second tube 111, more specifically, the second magnet 114 may be secured to the interior surface of the first portion 116. The second magnet 114 may have a length equal to the interior circumference of the first portion 116 and a width equal to the height of the first portion 116. The second magnet 114 may cover an entirety of the interior surface of the first portion 116.

The external circumference of the first end 108 of the first elongate member 103 may be sized to be slightly smaller than or equal to the interior circumference of the first end 112 of the second elongate member 104 to provide a water tight fit between the two members 103, 104. The interior circumference of the first end 108 of the first elongate member 103 may be equal to the interior circumference of the third portion 118 of the second tube 111.

The straw component 101 may be stored in a nested configuration. In this nested configuration, as depicted in FIG. 1, the second end 111 of the second elongate member 104 may receive the second end 109 of the first elongate member 103. The first elongate member 103 may be positioned within the second elongate member 104 so the second end 109 of the first elongate member 103 contacts the transition portion 119 or third portion 118 of the second tube 111. In this nested configuration, the straw component may be positioned in and carried by the container component 102.

The container component 102 may include a receiving component 105 and a lid component 106. The receiving component 105 may be a cylinder elongate member with an open end 120 and an opposing closed end 121. The interior circumference of the container component 102 may be larger than the exterior circumference of the second elongate member 104, The container component 102 may include a lid recess 122 at the open end 120. The lid recess 122 may be defined by a portion of the exterior surface of the container component 102 having a smaller exterior circumference than the remainder of the container component 102. The interior circumference of the container component 102 may be uniform along an entirety of the length of the container component 102. The difference between the exterior circumference of the lid recess 122 and the exterior circumference of the remainder of the container component 102 may be equal to the thickness of a sidewall of the lid component 106.

The receiving component 105 may carry at least a portion of the first elongate member 103 and second elongate member 104 when in the nested configuration. The first end 108 of the first elongate member 103 may be positioned proximate the closed end 121 of the receiving component 105. In some embodiments, a post 123 may be secured to an interior surface of the closed end 121 of the receiving component 105. The post may extend upwardly from the closed end 121 of the receiving component 105 into the cavity defined by the walls of the receiving component 105. The post may have an exterior circumference smaller than the interior circumference of the first end 108 of the first tube 107. The first end 108 of the first tube 107 may be positioned to contact the closed end 121 of the receiving component 105. In such an embodiment, the post 123 may extend into the interior of the first end 108 of the first tube 107 to engage the first end 108 of the first tube 107 of the first elongate member 103. A third magnet 124 may be secured to the post 123, The third magnet 124 and the first magnet 110 may attract one another. Such a configuration may reinforce the attachment of the first magnet 110 to the first tube 107. The third magnet 124 may be a flexible, elongate structure. The third magnet 124 may be secured to the post 123 around an entirety of the circumference of the post 123. The third magnet 124 may have an adhesive backing, which may be secured to the exterior surface of the post 123. The third magnet 124 may have a length equal to the exterior circumference of the post 123 and a width equal to the height of the post 123. The third magnet 124 may cover an entirety of the lateral surface of the post 123.

The lid component 106 may be an elongate cylindrical member having an open end and an opposing closed end. The open end of the lid component 106 may be sized to receive and carry the open end of the receiving component 105. The lid component may be positioned and carried along an entirety of the length of the lid recess 122. The length of the lid component 106 and receiving component 105 when in the mated configuration may be greater than or equal to the length of the straw component 101 in the nested configuration. The receiving component 105 and lid component 106 may secure together and define a cavity by the interior surfaces of both components 105, 106.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

The invention claimed is:

1. A drinking straw comprising: a first elongate member comprising: a first tube having a first end with a first external circumference and a second end with a second external circumference greater than the first external circumference of the first end of the first tube wherein the first end of the first tube has a recess defined by an area of the first end having the first external circumference, and a first magnet secured to and covering an entirety of the recess; and a second elongate member comprising: a second tube having a uniform external circumference between a first end and a second end, and a second magnet secured to an internal surface of the second tube proximate the first end of the second tube; and wherein the first elongate member and the second elongate member are positionable into a coupled configuration defined by the first magnet and second magnet configured to attract one another and secure the first end of the first tube to the first end of the second tube in a coupled configuration; and wherein the first elongate member and second elongate member are positionable into a nested configuration wherein in the nested configuration the second end of the second elongate member receives the second end of the first elongate member.

2. The drinking straw of claim 1 wherein the first end of the second tube is configured to receive and carry the first end of the first tube.

3. The drinking straw of claim 1 wherein the first end of the second elongate member has an interior diameter greater than an exterior diameter of the first end of the first elongate member.

4. The drinking straw of claim 1 wherein the second tube has a first portion having a first interior diameter and a second portion having a second interior diameter less than the first interior diameter.

5. The drinking straw of claim 4 wherein the second tube has a transition portion located between the first portion and the second portion and the transition portion has a tapered interior diameter.

6. The drinking straw of claim 5 wherein the tapered interior diameter of the transition portion forms a 135-degree angle with respect to an interior surface of the second portion.

7. The drinking straw of claim 4 wherein the second tube has a third portion having a third interior diameter greater than the first interior diameter.

8. The drinking straw of claim 7 wherein the second magnet is secured to an interior surface of the third portion.

9. The drinking straw of claim 8 wherein the second magnet covers an entirety of the interior surface of the first portion.

10. The drinking straw of claim 1 wherein the system further comprises: a receiving component configured to carry the first elongate member and second elongate member in the nested configuration; and a lid component configured to secure to an open end of the receiving component to store the first and second elongate members within a cavity defined by an interior surface of the receiving component and lid component.

11. The drinking straw of claim 10 wherein the receiving component further comprises a post secured to an interior side of a closed end of the receiving component and wherein the post is configured to engage the first end of the first elongate member.

12. The drinking straw of claim 11 wherein the receiving component further comprises a third magnet secured to the post and configured to attract the first magnet of the first elongate member in the nested configuration.

13. The drinking straw of claim 12 wherein the third magnet surrounds and entirety of a circumference of the post.

* * * * *